US008439553B2

(12) United States Patent
Galletti

(10) Patent No.: US 8,439,553 B2
(45) Date of Patent: May 14, 2013

(54) MIXTURE FOR CONCRETE AND SIMILAR MIXTURES ALLOWING AN EASY AND FAST MAINTENANCE

(75) Inventor: Paolo Galletti, Ponte Valleceppi (IT)

(73) Assignee: Officine Meccaniche Galletti O.M.G. Srl, Perugia (IT)

( * ) Notice: Subject to any disclaimer, the term of this patent is extended or adjusted under 35 U.S.C. 154(b) by 863 days.

(21) Appl. No.: 12/450,813

(22) PCT Filed: Jan. 8, 2008

(86) PCT No.: PCT/EP2008/050132

§ 371 (c)(1),
(2), (4) Date: Oct. 14, 2009

(87) PCT Pub. No.: WO2008/128794

PCT Pub. Date: Oct. 30, 2008

(65) Prior Publication Data

US 2010/0128553 A1 May 27, 2010

(30) Foreign Application Priority Data

Apr. 18, 2007 (IT) ..... MC20070020 U

(51) Int. Cl.
*B01F 7/00* (2006.01)

(52) U.S. Cl.
USPC ..... 366/64; 366/279; 366/601

(58) Field of Classification Search ..... 366/64, 366/66, 279, 601, 292; 74/661
See application file for complete search history.

(56) References Cited

U.S. PATENT DOCUMENTS

| | | | | |
|---|---|---|---|---|
| 5,348,448 | A * | 9/1994 | Ikemoto et al. | 417/17 |
| 5,447,371 | A * | 9/1995 | Agapiou | 366/290 |
| 6,340,439 | B1 * | 1/2002 | Hiraoka | 264/40.1 |
| 2009/0001096 | A1 * | 1/2009 | Wagner et al. | 222/1 |
| 2011/0095048 | A1 * | 4/2011 | Wagner et al. | 222/1 |

FOREIGN PATENT DOCUMENTS

| | | | |
|---|---|---|---|
| CN | 1496802 | A | 5/2004 |
| DE | 3814211 | C1 | 4/1989 |
| GB | 2089597 | A | 6/1982 |

OTHER PUBLICATIONS

International Search report mailed Apr. 21, 2008 in PCT/EP2008/050132, 2 pages.

* cited by examiner

*Primary Examiner* — Tony G Soohoo
(74) *Attorney, Agent, or Firm* — Lowe, Hauptman, Ham, & Berner, LLP

(57) ABSTRACT

The present invention relates to a mixer for concrete and similar mixtures, of the type composed of a parallelepiped tank (2) internally provided with one or more mixing shafts (3), each of them driven into rotation by a corresponding motor unit (UM) in external position with respect to the tank (2), which comprises, with the necessary connections, an electric motor (4), a gear motor (6) and a cascade of intermediate and reducing gears interfaced with the end of the corresponding mixing shaft (3), characterized by the fact that it is provided with a low-power auxiliary motor (10) connected with the main motor (4), designed to be actuated to drive into very slow rotations the mixing shaft, associated to the main motor (4) during the internal cleaning operations of the tank (2).

4 Claims, 1 Drawing Sheet

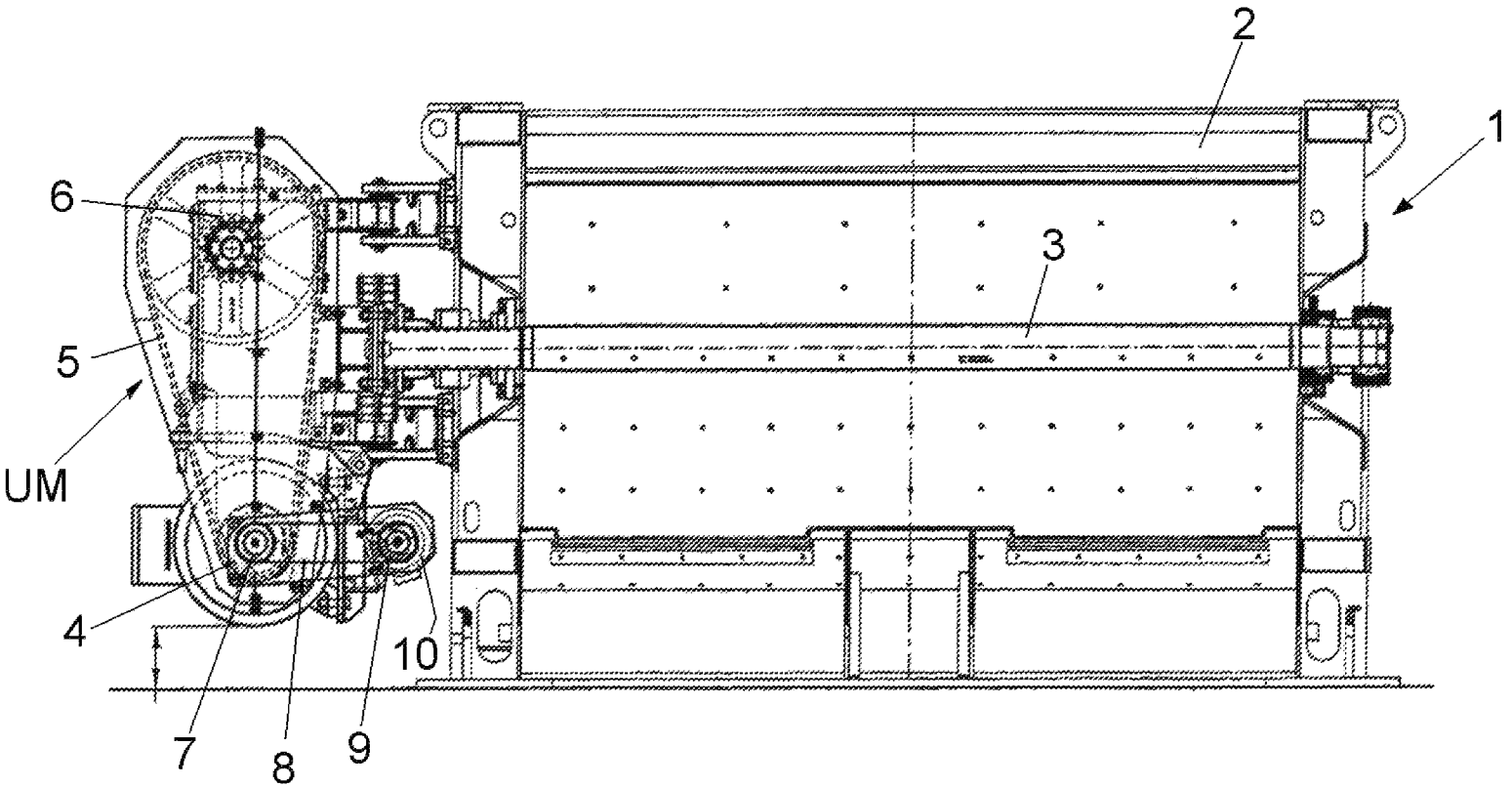
1
2
3
10
9
8
7
6
5
UM
4

MIXTURE FOR CONCRETE AND SIMILAR MIXTURES ALLOWING AN EASY AND FAST MAINTENANCE

The present patent application relates to a mixer for concrete, powders, dry and semi-dry granules characterised by easy and safe internal cleaning.

As it is known, the traditional mixers used in the most diverse sectors, with particular reference to the building sector, are composed of a large parallepiped tank with cylindrical or omega-shaped walls, in which one or more rotational shafts operate horizontally to mix the mixtures loaded in the tank.

The said shafts are provided with radial blades designed to interfere efficaciously interference with the mixture to be mixed.

The transversal borders of the tank are provided with housings used to insert the mixing shafts, with the interposition of suitable bearings and seal gaskets.

The motor units designed to drive each mixing shaft into rotation are mounted in external position on one or both transversal borders.

The motor unit is composed of an electric motor that actuates, either directly or by means of a transmission belt, a gear motor that transmits the rotational motion to the mixing shaft with the interposition of a series of intermediate and reducing gears.

In general, the said electric motor has a speed of approximately 1400 rpm, which corresponds to a speed reduced by ½ in the gear motor and a speed of approximately 25 rpm in the mixing shaft.

During the practical use of the said mixers, it is frequently necessary—preferably on a daily basis and in any case before the residual mortar consolidates—to clean the tank used to mix the different materials.

More precisely, it is necessary to remove the solid deposits of the mixture from the internal surfaces of the tank (including mixing shafts and their blades); this operation is normally carried out by an operator who can be positioned outside or inside the tank to ensure more efficacious cleaning.

In particular, the cleaning operation of the mixing shafts contained in the tank is especially difficult.

In view of the fact that each shaft must be cleaned on the external side and in the intersection point of the blades along the entire length, it is a normal procedure in this case to drive the shaft into short angular travels (by a few degrees at a time) in order to make the cleaning operation easier for the operator inside the tank.

In this way, the surface sections of the shaft to be cleaned are always directed upwards, that is to say in a more comfortable position for the operator.

In particular, short angular travels are imposed to each mixing shaft by means of short electrical impulses imposed on the electric motor used in the motor unit.

Such an operative principle is not considered to be fully satisfactory, especially because of the risks for the operator inside the tank when the mixing shaft are subject to the aforementioned short travels.

Possible malfunctioning of the device or negligence of the operator in charge of giving the said short impulses to the motor unit could result in the uncontrolled rotation of the mixing shafts at the normal operation speed, with lethal consequences for the operator in charge of cleaning.

It must be noted that the shafts radially support the heavy mixing blades that could cause very serious injuries in case of interference with the body of the operator at the normal rotational speed.

The specific purpose of the present invention is to improve the safety of a concrete mixer during the cleaning operation carried out by the operator inside the tank.

To that end, the logic principle based on the aforementioned intermittent forward travels of the mixing shafts obtained with short "consecutive steps" of the motor units has been completely abandoned.

Alternatively, the motor unit of the mixing shaft has been associated with a small gear motor that is used for the ordinary operation of the mixer, but is advantageously used during the internal cleaning operation of the mixer.

In such a case, the small gear motor is used to drive in rotation, with the interposition of the traditional motor unit, the corresponding mixing shaft at a very low rotational speed (1 rpm).

It appears evident that the slow rotation of the mixing shaft is not dangerous for the cleaning operator inside the tank.

As a matter of fact, the operator will be able to avoid the heavy radial blades that rotate very slowly inside the mixing tank.

For purposes of clarity the description of the present invention continues with reference to the enclosed drawing, which is intended for purposes of illustration only and not in a limiting sense, whereby FIG. 1 is a lateral view of the mixer of the invention.

With reference to the said figure, the mixer (1) is traditionally composed of a parallepiped tank (2) provided with one or more rotational shafts (3) horizontally supported between the transversal borders in order to mix the mixture contained in the tank (2).

Each shaft (3) is actuated by a corresponding motor unit (UM) composed of an electric motor (4) connected by means of a belt (5) to a gear motor (6) connected to the corresponding mixing shaft (3) by means of a cascade of intermediate and reducing gears.

The motor (4) is considerably powerful because, with the interposition of the gear motor (6) and the cascade of gears, it drives the corresponding mixing shaft (3) at a speed that is sufficiently high to ensure the perfect mixing of the dense heavy mixture contained in the tank (2).

Within the said traditional configuration, a free wheel (7) is applied to the shaft of the main electric motor (4), and mounted in such a position that it does not participate in the normal rotation of the electric motor (4).

The free wheel (7) is connected by means of a belt (8) to a pulley (9) splined to the shaft of an electric motor with low power (10), preferably 1 CV, which is mounted in adjacent position to the main electric motor (4), being capable of actuating it.

Before the cleaning operation, the main motor (4) is disconnected and the auxiliary motor with low power (10) is powered.

Because of the interposition of the transmission belt (9), the actuation of the auxiliary motor (10) causes the rotation of the free wheel (7) and consequently of the main motor (4) on which the free wheel (7) is splined.

The rotation imposed to the shaft of the main motor (4) is designed to drive in the same rotation direction the entire kinematic chain composed of the gear motor (6), the cascade of intermediate and reducing gears and the mixing shaft (3).

In view of the fact that the power of the auxiliary motor (10) is quite limited and the motor unit (UM) connected to it ensures the reduction of the rotation speed of the shaft of the same auxiliary motor (10), it appears evident that the mixing shaft (3) makes extremely slow rotation travels, which are almost imperceptible, thus permitting the operator in the tank to interfere with total safety and maximum efficiency with the surface of the tank and remove the solid deposits.

Preferably, the rotational speed of the auxiliary motor (10) is 60-70 rpm, which corresponds to a rotational speed of 1 rpm in the rotational shaft (3).

Finally, it must be noted that, without leaving the scope of this inventive idea, a different realisation mode of the "selective" connection between the auxiliary motor (10) and the main motor (4) of the motor unit (UM) can be provided.

Only for illustrative, not limiting purposes, a clutch can be provided between the shafts of the main (4) and auxiliary (10) motors, being evident, in this case, that the two motors can have the same rotational direction.

In case of mixers provided with a single mixing shaft and a single motor unit, a single auxiliary motor (10) is associated to the motor unit.

However, the use of a single auxiliary motor is also provided in case of mixers with two or more mixing shafts, because, in such a case, the mixing shafts are coupled by means of constant-velocity joints.

Because of this, although the auxiliary motor (10) drives in rotation only the specific unit motor associated with it, the rotation of the mixing shaft directly actuated by the latter involves the contemporary rotation (by means of the connection provided by the constant-velocity joint) of the adjacent s mixing shaft or shafts.

The invention claimed is:

1. Mixer for concrete, comprising:

a parallelepiped tank internally provided with one or more mixing shafts, at least one motor unit in an external position with respect to the tank to driven into rotation said one or more mixing shafts, said motor unit comprising a main motor, a gear motor, a cascade of intermediate and reducing gears interfaced with an end of said one or more mixing shafts, and a low-power auxiliary motor connected with the main motor of the motor unit through a free wheel;

wherein the free wheel is configured to during a normal activation of the main motor and a contemporary deactivation of the auxiliary motor, prevent the auxiliary motor from being driven into rotation by the main motor, and during a deactivation of the main motor and a contemporary activation of the auxiliary motor, allow the auxiliary motor to drive the main motor into rotation, and said auxiliary motor has 1 horse power, and the motor unit connected to the auxiliary motor to reduce a rotation speed of a shaft of the auxiliary motor so that an operator is able to perform maintenance operation in the tank.

2. The mixer as claimed in claim 1, wherein the rotational speed of the auxiliary motor is 60-70rpm, which corresponds to a rotational speed of 1 rpm in said one of one or more mixing shafts.

3. The mixer as claimed in claim 1, wherein the free wheel is mounted on a shaft of the main motor and connected by means of a belt to a pulley splined on the shaft of the auxiliary motor.

4. The mixer as claimed in claim 1, further comprising a clutch mounted between a shaft of the main motor and the shaft of auxiliary motor.

* * * * *